US005676270A

United States Patent [19]

Roberts

[11] Patent Number: 5,676,270

[45] Date of Patent: Oct. 14, 1997

[54] THREADED CONTAINER TORQUE RETENTION SYSTEM FOR USE WITH A THREADED CLOSURE

[75] Inventor: Charles E. Roberts, Eagle, Wis.

[73] Assignee: AptarGroup, Inc., Crystal Lake, Ill.

[21] Appl. No.: 661,953

[22] Filed: Jun. 12, 1996

[51] Int. Cl.[6] ..... B65D 41/04

[52] U.S. Cl. ..... 215/330; 220/289

[58] Field of Search ..... 215/329, 330, 215/331, 217, 218; 220/288, 289

[56] References Cited

U.S. PATENT DOCUMENTS

| | | | |
|---|---|---|---|
| 3,405,831 | 10/1968 | Hudson | 215/330 |
| 3,511,403 | 5/1970 | Braun | 215/330 |
| 3,682,345 | 8/1972 | Baugh | 215/330 |
| 4,494,665 | 1/1985 | Lehmann . | |
| 4,553,678 | 11/1985 | Thorsbakken | 215/218 |
| 4,669,624 | 6/1987 | Wiles et al. | 215/334 |
| 4,697,715 | 10/1987 | Beruvides . | |
| 4,770,308 | 9/1988 | Lynn | 215/330 |
| 4,934,547 | 6/1990 | Mayes et al. . | |
| 5,096,083 | 3/1992 | Shaw et al. . | |
| 5,145,080 | 9/1992 | Imberry, Jr. | 215/330 X |
| 5,169,033 | 12/1992 | Shay | 215/330 X |
| 5,186,344 | 2/1993 | Cook . | |
| 5,462,186 | 10/1995 | Ladina et al. . | |

FOREIGN PATENT DOCUMENTS

| | | | |
|---|---|---|---|
| 282060 | 11/1990 | Japan | 215/330 |

*Primary Examiner*—Allan N. Shoap
*Assistant Examiner*—Nathan Newhouse
*Attorney, Agent, or Firm*—Dressler, Rockey, Milnamow & Katz, Ltd.

[57] ABSTRACT

A removal torque-resistant closure and container assembly is provided with the container having a thread extending around the opening. The closure includes a thread for engaging the container thread. The container includes a projection that extends from the thread root between two adjacent thread crests on the container and that defines an outer edge for temporarily deforming the closure thread during relative rotational movement of the container and closure when the container and closure are screwed together. Upon termination of the screwing action, the container projection edge is engaged with a deformed region of the closure thread so as to resist closure removal by unscrewing.

19 Claims, 5 Drawing Sheets

THREADED CONTAINER TORQUE RETENTION SYSTEM FOR USE WITH A THREADED CLOSURE

TECHNICAL FIELD

This invention relates to a package in the form of an assembly of a container and closure thereon.

BACKGROUND OF THE INVENTION AND TECHNICAL PROBLEMS POSED BY THE PRIOR ART

A common type of container has a threaded neck and is adapted to receive a threaded closure in the form of a cap or the like. A number of such threaded closures are provided with a dispensing feature, such as a body or base defining a dispensing orifice and a cooperating lid. The lid is disposed in the closure base and is adapted to be moved between (1) a lowered, closed position occluding the dispensing orifice and (2) an open position away from the dispensing orifice permitting the container contents to be discharged through the orifice.

In many applications, such a closure is initially applied to a container by an automatic closure applying apparatus, such as a high-speed capping machine. While threaded closures function generally satisfactorily, in some applications it may be desirable to reduce the ease with which such a closure can be unscrewed from the container neck.

Further, it would be advantageous to provide an improved closure/container assembly which has decreased susceptibility to closure loosening during normal shipping, storing, and handling. In some cases, a conventional threaded closure may undergo some amount of back-off or loosening from the threaded container neck during shipment and/or when subjected to rough handling. Accordingly, it would be beneficial to provide an improved closure and container which, upon assembly, would exhibit a greater torque retention and greater resistance to back-off or removal.

The present invention provides an improved container and mating closure system which can accommodate designs having the above-discussed benefits and features.

SUMMARY OF THE INVENTION

A package is provided according to the present invention, and the package includes an assembly of a container and a removal resistant closure which exhibit improved torque retention. The design permits the closure to be applied to the container with a conventional, high-speed capping machine. The closure is securely held on the container in a way that significantly increases resistance to back-off or removal.

The container defines an opening, and the closure is applied to the container to occlude the opening. A suitable dispensing feature, such as a dispensing orifice and lid, can be optionally provided in the closure.

The container defines a thread which extends around the opening.

The closure defines a thread extending around the closure for threadingly engaging the container thread.

A projection is provided on the container neck. The projection extends from the thread root between two adjacent thread crests on the container. The projection defines an outer edge which temporarily deforms the closure thread during relative rotational movement of the container and closure when the closure and container are screwed together. Upon termination of the screwing action, the container projection edge is engaged with a deformed region of the closure threads so as to resist closure removal by unscrewing.

The system advantageously permits the closure to be screwed on to the container with an automatic capping machine. Compared to conventional threaded closures and containers, the system of the present invention increases the required application torque only slightly. Thus, conventional capping machines may be readily employed to screw the closure onto a container having the novel projection feature of the present invention.

However, once the closure has been properly screwed onto the container, the projection feature imposes a strong resistance to rotation of the closure in the unscrewing direction. Thus, the system of the present invention requires the application of a much greater removal torque in order to unscrew the closure. Preferably, according to a preferred form of the invention, the much higher torque required to unscrew the closure is substantially constant during the unscrewing process. Thus, the increased resistance to back-off or unscrewing is substantially constant and does not significantly decrease even if the closure is initially unscrewed a small amount.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described in the normal (upright) operating position, and terms such as upper, lower, horizontal, etc., are used with reference to this position. It will be understood, however, that the components of this invention may be manufactured, stored, transported, used, and sold in an orientation other than the position described.

The closure may be applied to a container of this invention with a conventional, high speed capping machine, the details of which, although not illustrated or described, will be apparent to those having skill in the art and an understanding of the necessary functions of such a machine. The detailed description of such a machine is not necessary to an understanding of the invention and are not herein presented because such a machine forms no part of the present invention.

Figure 1:
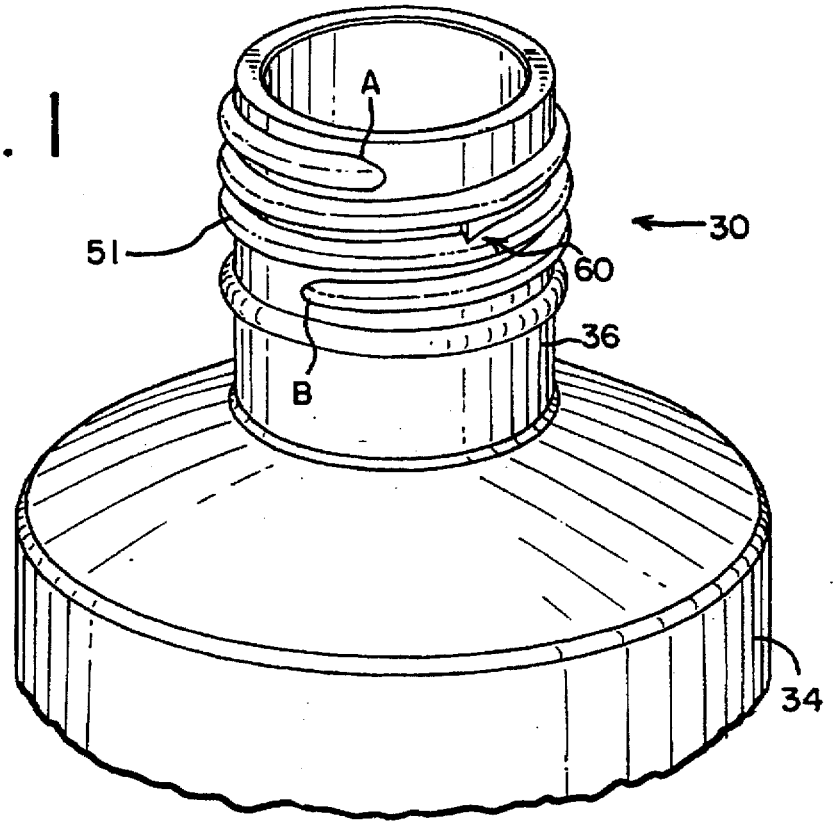
FIG. 1 is a fragmentary, perspective view of a preferred embodiment of the container of the present invention.
Figure 2:
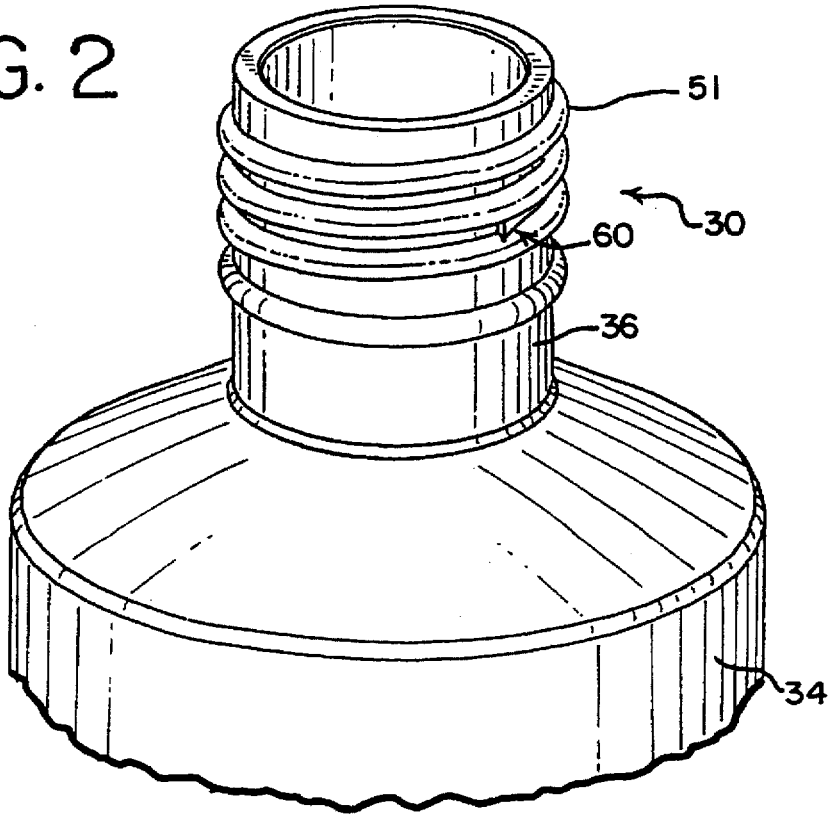
FIG. 2 is a view similar to FIG. 1, but FIG. 2 shows the container rotated about 180° from the position shown in FIG. 1.
Figure 3:
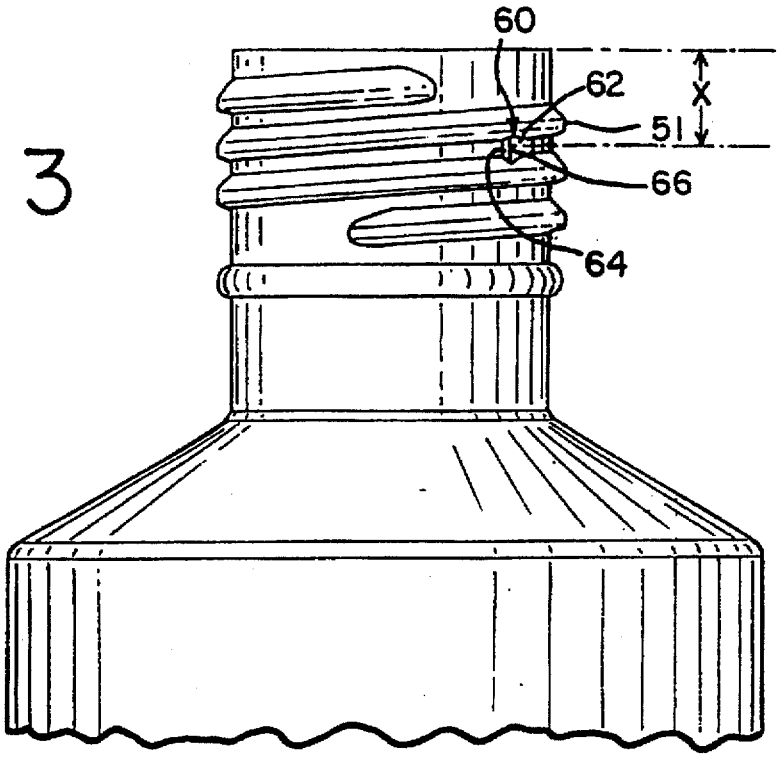
FIG. 3 is an enlarged, fragmentary, side-elevational view of the closure shown in FIG. 1.

The present invention provides a package in the form of a container and closure which incorporate a thread system for accommodating mounting of the closure on the container in a way that prevents easy removal of the closure. FIGS. 1–3 illustrate a first embodiment of the container designated generally by the reference number 30, and FIGS. 5–8 show a closure, designated generally by the reference number 32, mounted on the container 30.

The closure 32 is adapted to be threadingly mounted on the container 30. The container 30 typically includes a body portion or a receptacle portion 34 which may have any suitable, special or conventional configuration and from which a neck 36 extends (as shown in FIG. 1). The neck 36 defines an opening through which the container contents can be dispensed.

Figure 5:
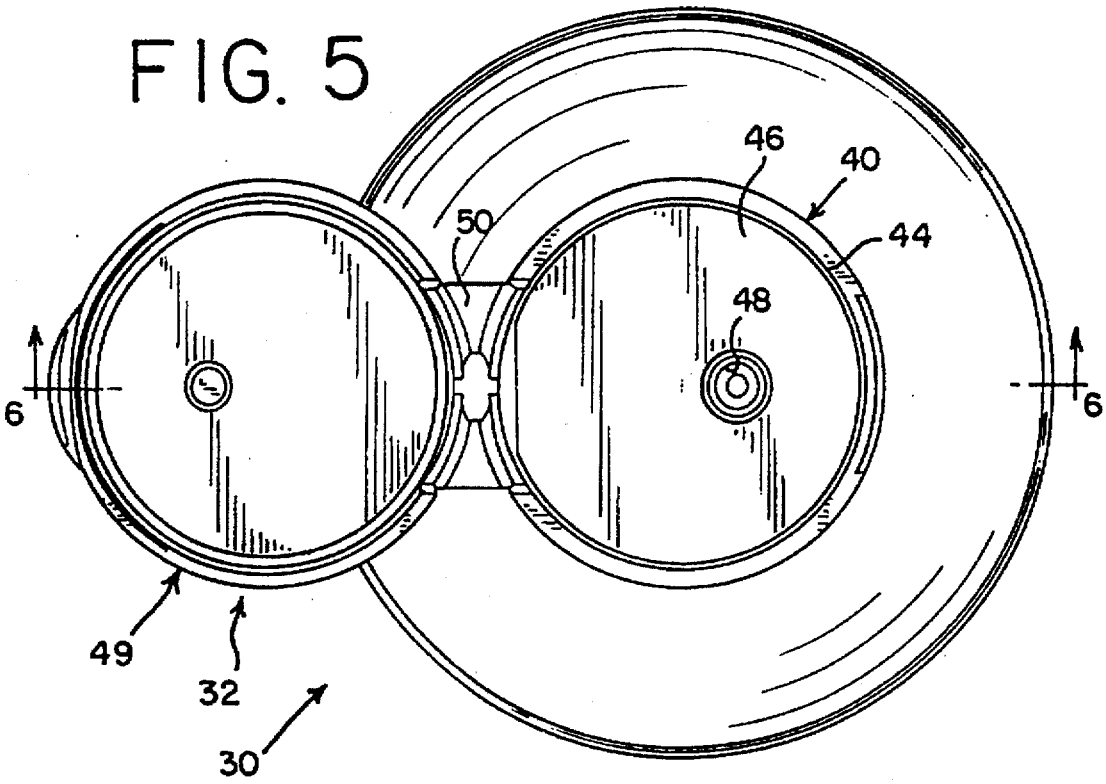
FIG. 5 is a top plan view of an open closure of the present invention threadingly assembled on the container of the present invention illustrated in FIGS. 1–4.
Figure 6:
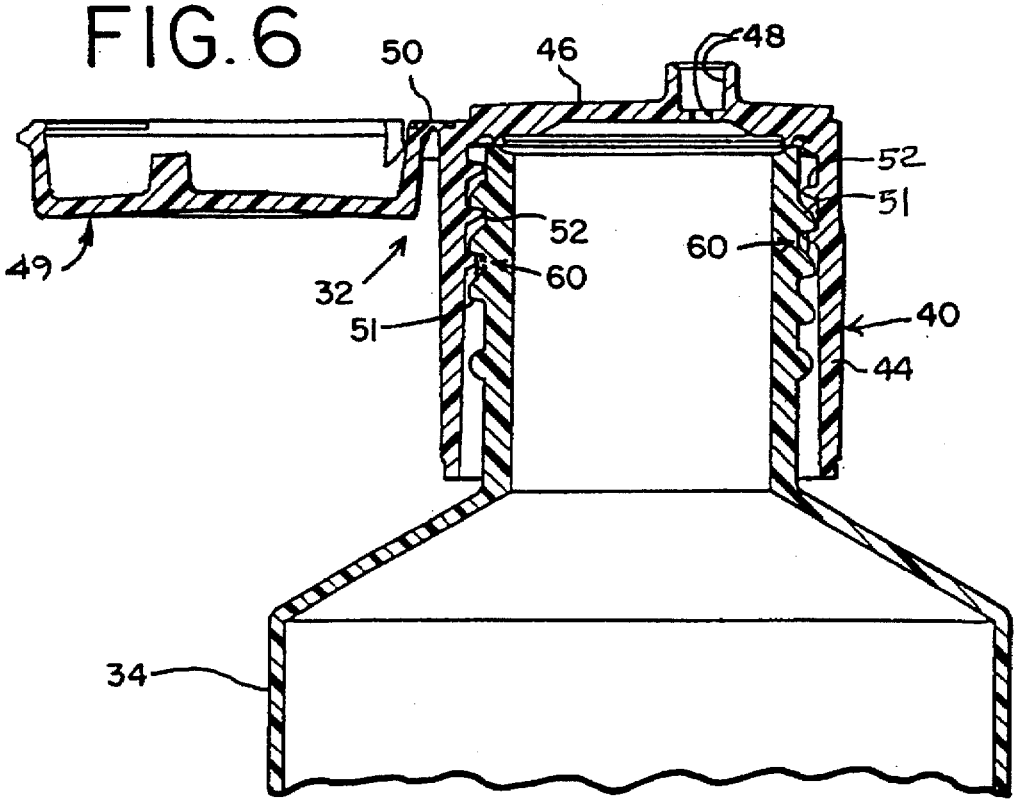
FIG. 6 is a fragmentary, cross-sectional view taken generally along the plane 6—6 in FIG. 5.
Figure 7:
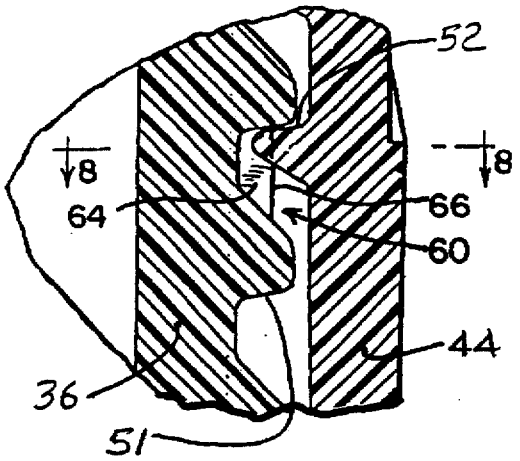
FIG. 7 is a greatly enlarged, fragmentary, cross-sectional view of a portion of the assembly illustrated in FIG. 6.

As best illustrated in FIGS. 5 and 6, the closure 32 includes a housing, base, or body 40 for securement to the container neck 36. The closure body 40 includes a peripheral wall in the form of a generally cylindrical skirt 44. Typically, the upper end of the closure skirt 44 is closed with, or merges with, a horizontal, transverse deck 46 which defines a suitable dispensing aperture or orifice 48. Typically, a lid 49 is connected to the closure base 40 with a unitary hinge 50, and the lid 49 can move between a closed position on the deck for occluding the orifice 48 and an open position (FIGS. 5 and 6) away from the deck 46 to permit the container contents to be dispensed through the orifice 48.

The container neck 36 has a generally cylindrical configuration. The exterior surface of the neck 36 defines a first thread 51 (which is preferably helical), and the closure skirt 44 defines, on its interior surface, a second thread 52 (FIG. 6) which is preferably helical.

The container thread 51 extends around the container neck 36. Similarly, the closure skirt thread 52 extends around the inside circumference of the skirt. The container thread 51 defines a leading end A and a trailing end B (FIG. 1). The closure thread 52 also has analogous leading and trailing ends (not visible).

Although the container neck thread 51 is illustrated as an exterior, male thread, and although the closure skirt thread 52 is illustrated as an interior, female thread 52, it will be appreciated that the thread 51 on the container neck 36 could be a female thread located on the inside of the container neck 36 while the thread 52 on the closure skirt 44 could be a male thread located on the outside of the closure skirt 44.

According to the present invention, the container 30 has a projection 60 that extends outwardly from the thread root between two adjacent thread crests of the container thread 51.

In the first embodiment illustrated in FIGS. 1–8, the container neck 36 has two projections 60, each about 180° apart and located at different axial elevations along the container thread 51. In an alternate form, only one projection 60 need be provided.

Each projection 60 defines a ramp 62 (FIGS. 3 and 4) which extends from the thread root between the adjacent crests of the container thread 51. Each projection 60 also defines an end surface 64 (FIGS. 3 and 4) which faces generally in the direction toward the trailing end of the container thread 51. The end surface 64 lies in a plane that contains a longitudinal axis defined by the helical container thread 51.

The ramp 62 and the end surface 64 both terminate at a common edge 66 which defines the outermost part of the projection 60.

In a presently contemplated preferred embodiment, the end surface 64 lies along a radius of the helical thread 51 and has a radial width (dimension U in FIG. 4) of 0.025 inch. Preferably, the outer edge 66 projects from the thread root more than one-half of the height of the thread crest.

Preferably, the ramp 62 defines an included angle (reference angle W in FIG. 4) with the end surface 64 wherein the vertex of the angle is defined at the edge 66. In a presently preferred embodiment, the angle W is 70 °, 48 minutes.

Figure 4:
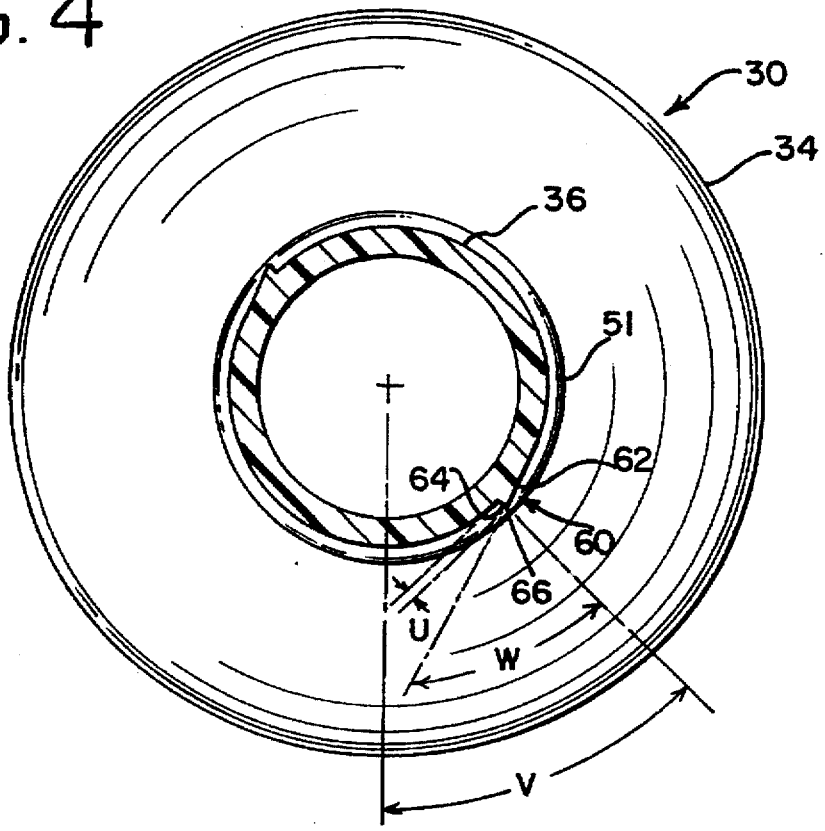
FIG. 4 is a cross-sectional view taken generally along the planes 4—4 in FIG. 3.

Also, the projection 60 that is visible in the side elevational view in FIG. 3 is preferably located 45° from the start of the full thread adjacent the thread leading end A (as indicated by the reference angle V in FIG. 4). The other projection 60 is located 180° from the projection 60 that is visible in FIG. 3.

Preferably, the projection 60 that is visible in FIG. 3 is located about 0.255 inch below the top of the container neck 36, and the other projection is located about 0.330 inch below the top of the container neck 36. That is, there is a 0.075 inch elevation difference between the two projections. The distances 0.255 inch and 0.330 inch are measured to the vertical mid point of the projection ramp 62 where the ramp 62 merges with the container neck 36 between two adjacent thread crests. The 0.255 inch distance is indicated by the reference dimension X in FIG. 3.

When the closure 32 is threaded onto the container neck 36, the leading end of the closure thread 52 moves between adjacent crests of the container neck thread 51. When the leading end of the closure thread 52 engages the ramp 62 of the container projection 60, the closure thread 52 is gradually deformed such that it becomes somewhat flattened to enable it to pass over the ramp 62 and edge 66. This is a cold forming deformation process which requires that the closure 32 (and/or container 30) be rotated with somewhat greater torque than is necessary with a conventional container thread system.

Figure 8:
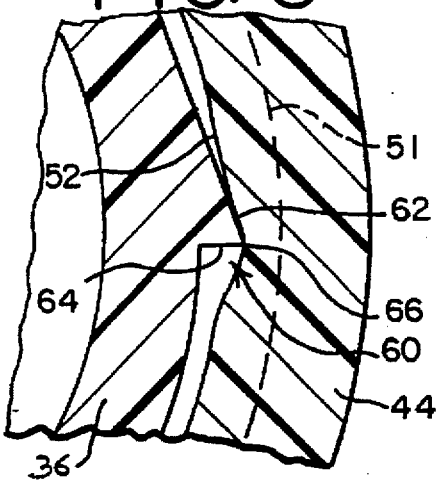
FIG. 8 is a fragmentary, cross-sectional view taken generally along the plane 8—8 in FIG. 7.
Figure 9:
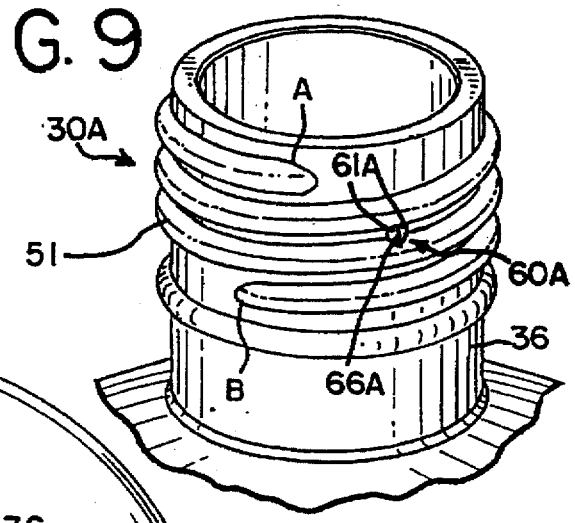
FIG. 9 is a view similar to FIG. 1, but FIG. 9 shows a second embodiment of the container of the present invention.

When the closure 32 has been completely threaded onto the container, the cold-formed, flattened portion of the closure thread 52 which has moved past the projection 60 returns substantially the pre-deformed condition. The region of the closure thread 52 adjacent the projection 60 remains deformed around the projection 60. The projection edge 60, and to some extent the end surface 64, is engaged with the deformed closure thread 52 as shown in FIG. 8. This creates substantial resistance to closure rotation in the unthreading direction. Thus, resistance to back-off is achieved.

The torque required to remove the closure is considerably higher than with a conventional container thread system. The container thread system of the present invention provides a substantially constant, high resistance to closure removal when a sufficiently high removal torque is applied to remove the closure.

Figure 10:
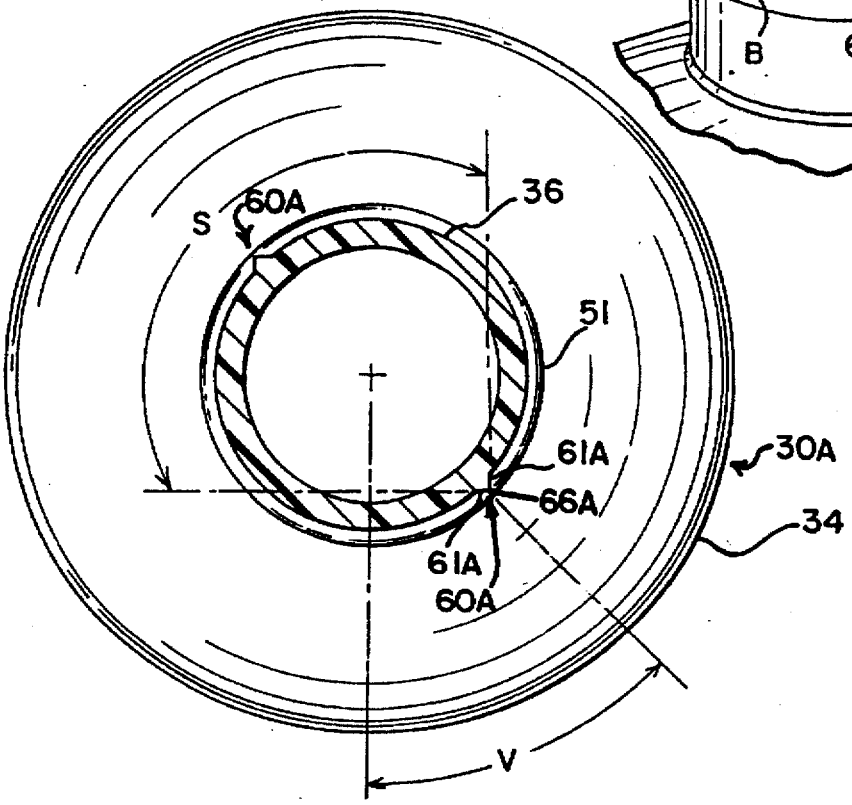
FIG. 10 is a cross-sectional view similar to FIG. 4, but FIG. 10 shows the second embodiment illustrated in FIG. 9.

FIG. 10 illustrates a second embodiment of the container 30A having a projection 60A. The projection 60A has a V-shaped configuration defined by two angled surfaces 61A which meet at an edge 66A. Preferably, two such projections 60A are provided 180° apart on the container 30A.

Preferably, as illustrated in FIG. 10, the surfaces 61A which form the opposite sides of the projection 60A define an included angle S of 90°.

Figure 11:
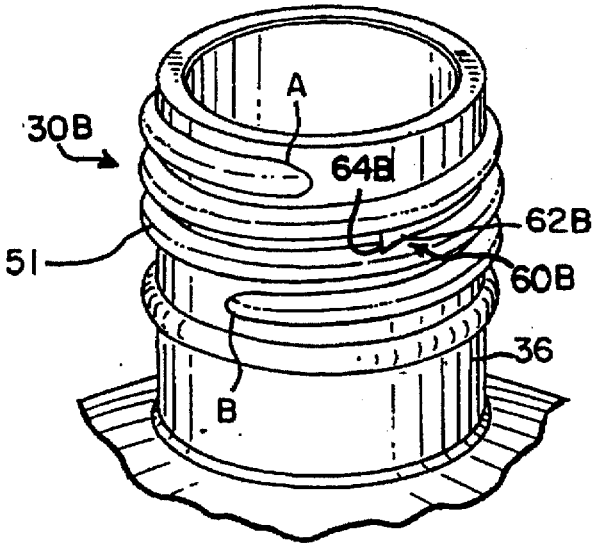
FIG. 11 is a view similar to FIG. 1, but FIG. 11 shows a third embodiment of the container of the present invention.
Figure 12:
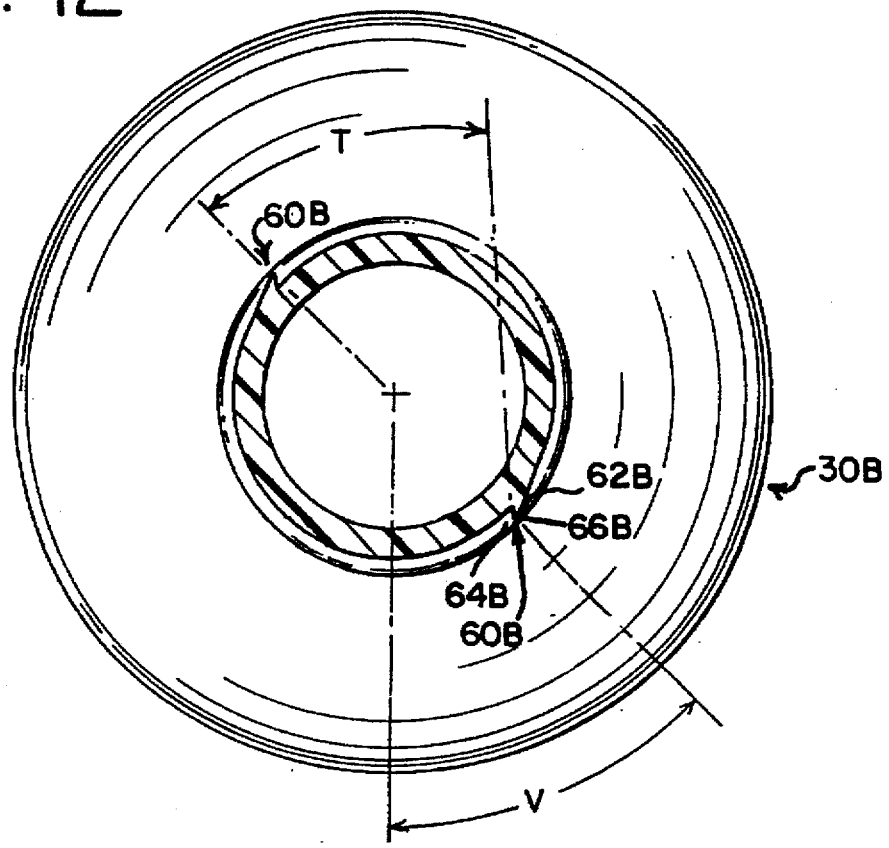
FIG. 12 is a view similar to FIG. 4, but FIG. 12 shows the third embodiment illustrated in FIG. 11.

FIGS. 11 and 12 illustrate a third embodiment of the container 30B having a projection 60B. Preferably, two such projections 60B are provided 180° apart.

The projection 60B has a ramp 62B and an undercut, angled surface 64B. The ramp 62B and surface 64B meet at an edge 66B. The edge 66B lies at the vertex of an acute, included angle defined by the projection 60B. As illustrated in FIG. 12, the surface 64B defines an angle T with the radius line of the container passing through the edge 66B. Preferably, the angle T is 40°.

The container and closure assembly of the present invention may be molded from suitable thermoplastic materials, such as polypropylene and the like. The invention can be embodied in closures and containers produced with conventional manufacturing operations which do not require excessively high or close tolerances. The closure and container components of the present invention accommodate assembly with conventional capping machines and provide a package that inhibits or resists closure removal unless a relatively high removal torque is applied.

It will be readily apparent from the foregoing detailed description of the invention and from the illustrations thereof that numerous variations and modifications may be effected without departing from the true spirit and scope of the novel concepts or principles of this invention.

What is claimed is:

1. A removal torque-resistant closure and container assembly comprising:

a container defining an opening and a thread extending around said opening;

a closure for being applied to said container to occlude said opening, said closure defining a thread extending around said closure for threadingly engaging said container thread, said container thread having its adjacent turns spaced apart at the thread root; and a projection that (1) extends radially from the container thread root, (2) extends in the axial direction across the entire width of the thread root to merge with each of said two adjacent thread turns on said container, and (3) defines a generally rigid outer edge for temporarily deforming said closure thread during relative rotational movement of said container and closure when said closure and container are screwed together whereby upon termination of the screwing action, said container projection outer edge is engaged with an adjacent deformed region of said closure thread so as to resist closure removal by unscrewing.

2. The assembly in accordance with claim 1 in which said container and said closure thread each includes a helical portion.

3. The assembly in accordance with claim 2 in which said container thread is a male thread and said closure thread is a female thread.

4. The assembly in accordance with claim 2 in which said container includes two of said projections.

5. The assembly in accordance with claim 4 in which said two projections are about 180° apart.

6. The assembly in accordance with claim 5 in which one of said projections is about 45° from the start of the full thread adjacent a leading end of said container thread.

7. The assembly in accordance with claim 1 in which said outer projection edge projects outwardly more than one half of the height of said container thread crest and less than the height of said container thread crest.

8. The assembly in accordance with claim 1 in which said projection defines a ramp extending from the thread root between said adjacent container thread crests; and said outer edge defines the outermost part of said projection.

9. The assembly in accordance with claim 1 in which said projection defines an end surface facing generally in the direction toward a trailing end of said container thread.

10. The assembly in accordance with claim 9 in which said projection end surface lies in a plane that contains a central longitudinal axis defined by said container thread.

11. The assembly in accordance with claim 1 in which said container includes a neck and said container thread is defined on said neck.

12. The assembly in accordance with claim 1 in which said projection outer edge is defined by a V-shaped configuration of said projection.

13. The assembly in accordance with claim 1 in which said outer edge is located at the vertex of an acute included angle defined by said projection.

14. The assembly in accordance with claim 1 in which said container includes two of said projections; and said projections are located at different axial elevations along said container thread.

15. A removal torque-resistant closure and container assembly comprising:

a container having a neck defining an opening and a male thread extending around said opening from a leading end to a trailing end;

a closure for being applied to said container to occlude said opening, said closure having a skirt defining a female thread extending around said closure from a leading end to a trailing end for threadingly engaging said container thread, said container thread having its adjacent turns spaced apart at the thread root; and two projections circumferentially arranged on said container neck about 180° apart and at different axial elevations, each said projection being located on said container neck more than one-half turn from said container neck male thread leading end as measured along said male thread starting at its leading end, each said projection extending radially from the container thread root, each said projection also extending in the axial direction across the entire width of the thread root to merge with each of said two adjacent thread turns on said container, and each said pro projection defining a generally rigid outer edge for temporarily deforming said closure thread during relative rotational movement of said container and closure when said closure and container are screwed together whereby upon termination of the screwing action, said container projection outer edge is engaged with an adjacent deformed region of said closure thread so as to resist closure removal by unscrewing.

16. The assembly in accordance with claim 15 in which said container and said closure thread each includes a helical portion.

17. The assembly in accordance with claim 15 in which one of said projections is about 45° from the start of the full thread adjacent said leading end of said container thread.

18. The assembly in accordance with claim 15 in which said projection outer edge projects outwardly more than one half of the height of said container thread crest and less than the height of said container thread crest.

19. The assembly in accordance with claim 15 in which said projection defines a ramp extending from the thread root between said adjacent container thread crests;

said outer edge defines the outermost part of said projection;

said projection defines an end surface facing generally in the direction toward said trailing end of said container thread; and said projection end surface lies in a plane that contains a central longitudinal axis defined by said container thread.

* * * * *